United States Patent [19]

Hayashi

[11] 4,413,857

[45] Nov. 8, 1983

[54] SEAT COVER

[75] Inventor: Kazuo Hayashi, Yokohama, Japan

[73] Assignee: Nissan Motor Co., Ltd., Yokohama, Japan

[21] Appl. No.: 203,463

[22] Filed: Nov. 3, 1980

[30] Foreign Application Priority Data

Nov. 6, 1979 [JP] Japan ..... 54-153946[U]

[51] Int. Cl.[3] ..... A47C 7/72

[52] U.S. Cl. ..... 297/180; 297/453

[58] Field of Search ..... 297/180, 453, 219–229

[56] References Cited

U.S. PATENT DOCUMENTS

| | | | |
|---|---|---|---|
| 1,982,516 | 11/1934 | Holmested | 297/453 |
| 2,544,506 | 3/1951 | Kronhaus | 297/180 |
| 2,712,592 | 7/1955 | Goldstein | 297/180 |
| 2,731,542 | 1/1956 | Daniels | 297/180 |
| 2,912,832 | 11/1959 | Clark | 297/180 |
| 3,030,145 | 4/1962 | Kottemann | 297/180 |
| 3,136,577 | 6/1964 | Richard | 297/180 |
| 3,137,523 | 6/1964 | Karner | 297/180 |
| 3,162,489 | 12/1964 | Trotman | 297/180 |
| 3,621,192 | 11/1971 | Pohler | 297/180 |
| 3,681,797 | 8/1972 | Messner | 297/180 |

FOREIGN PATENT DOCUMENTS

| | | | |
|---|---|---|---|
| 2825597 | 12/1978 | Fed. Rep. of Germany | 297/180 |

*Primary Examiner*—Francis K. Zugel

[57] ABSTRACT

A seat cover (1) mounted on a vehicle seat (A) is used as a heater in winter and as a ventilator in summer. A flexible main body (9, 9') has on its one side an electric heater (10) and on the other side a number of holes (13) through which air is discharged by a blower (32). The main body includes a core (22, 35) which defines therein a passage (8) for the air. The core consists of resilient material and includes a base plate (**22*b*, 35*a*) which is provided with a number of projections (22*a*, 35*c***) projecting from at least one side of the base plate. The core improves flexibility of the seat cover to conform with both the user's body and the vehicle seat, while providing a sufficient rigidity to prevent closure of the air passage when the user's weight is applied thereto.

4 Claims, 12 Drawing Figures

SEAT COVER

BACKGROUND OF THE INVENTION

1. Field of the Invention

The present invention relates to a cover for a seat of a vehicle and the like, and more particularly to a seat cover which serves as a heater in winter and as a ventilator in summer.

2. Description of the Prior Art

Conventionally, various types of seat covers are known which are suitably used in some season of the year only. For example, a seat cover preferably used in winter usually consists of wool or similar material which provides a sufficient heat storing capacity and a warm appearance. Further, it is desirable to use during summer a seat cover which provides an excellent air permeability and a cool appearance. Generally, however, such a material is not available with a reasonable cost and, in selecting the material, the appearance played a major role than the functional characteristics. Thus, the driver or passenger on the seat tends to sweat in summer due to the heat storing capacity of the human body and the seat, and to feel cool in winter as the seat itself is not sufficiently warm. Moreover, when the above-mentioned two types of seat covers are used alternately, one of them has to be replaced with the other at each end of the corresponding season. The seat cover which will not be used in the subsequent season has to be cleaned and stored requiring an expenditure of time and storage space.

In an attempt to eliminate the above-mentioned drawbacks, there has been proposed a seat cover which can be used through all the seasons of the year. This seat cover has an electric heater adapted to heat one side of the seat cover, and a ventilating blower adapted to discharge air through an opposite surface of the seat cover. In winter, the driver or passenger sits on the surface which serves as an auxiliary heater. The seat cover is used upside-down or reversed in summer so that the discharged air cools the other surface of the seat cover and the human body thereon, to prevent the heat storage and promote dissipation or evaporation of sweat. Such a seat cover includes a core which consists of hollow material to define an air passage. In order to improve the user's comfort, the core should have a sufficient flexibility so that the seat cover conforms with the seat and the user's body. However, when the core is deformed by the user's weight, the air passage is closed so that an efficient cooling cannot be achieved. After a long period of use, the core becomes flat closing the air passage, and such a deformation cannot be recovered so that the appearance of the seat cover is greatly injured. In order to prevent closure of the air passage and permanent deformation of the seat cover, the core should have a sufficient rigidity. But, in this case, due to insufficient flexibility, the user's comfort cannot be expected.

SUMMARY OF THE INVENTION

Therefore, it is an object of the present invention to provide an improved seat cover which mitigates the above-mentioned disadvantages.

According to the present invention, there is provided a seat cover which can be mounted on a vehicle seat and used as a heater and as a ventilator, comprising in combination:

a flat main body including a core which consists of resilient material and defines therein an air passage;

a motor-driven blower which discharges air from one side of the main body, through the air passage in the core;

an electric heater which is plain and disposed on the other side of the main body;

said core including a flexible base plate and a plurality of projections which project from at least one side of the base plate to define therebetween said air passage.

The present invention will now be explained more in detail by referring to the preferred embodiments shown in the accompanying drawings.

DETAILED EXPLANATION OF THE PREFERRED EMBODIMENTS

Figure 1:
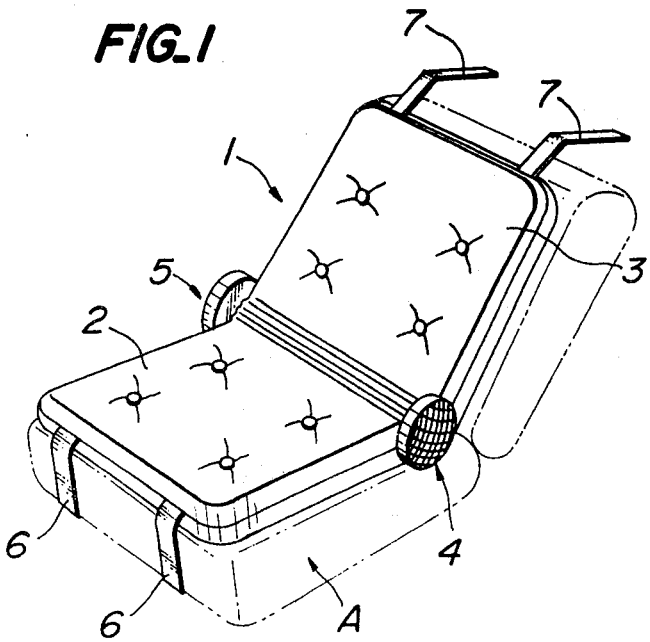
FIG. 1 is a perspective view of a seat cover according to one embodiment of the present invention, the seat cover being mounted on a vehicle seat.

Referring now to FIGS. 1 to 5, there is shown a seat cover 1 according to one preferred embodiment of the present invention. The seat cover 1 comprises a seat portion 2 and a back portion 3 which are integrally formed. On both sides of the connection between the two portions 2 and 3, there are mounted an air recirculating device 4 and a temperature controller 5. The seat cover 1 is mounted on the seat A and held in position by hooks 6 and deformable clips 7 made of metallic strip.

The seat portion 2 and the back portion 3 include hollow main bodies 9, 9', respectively, each of which defines therein an air passage 8. The main bodies 9, 9' are provided with electric heating elements 10, 10, respectively, which are plain and covered by a common layer 11 of cushion material which provides an excellent heat storing capacity. The cushion layer 11 is covered by a trimming sheet 12. On the opposite side, the main bodies 9, 9' are formed with a number of holes 13 which are in communication with the air passage 8. Those holes 13 are covered by a cushion layer 14 which provides an excellent air permeability. This cushion layer 14 is covered by a trimming sheet 15 which also is formed with a number of holes, not shown. At the connection between the seat portion 2 and the back portion 3, the air passages 8 in the main bodies 9, 9' are communicated with each other through a flexible tube 16. On both sides of the flexible tube 16, the main bodies 9, 9' are provided with generally cylindrical projections 17 for accommodating the air recirculating device 4 and the temperature controller 5. In order to improve the heat radiating efficiency, there may be disposed between the surfaces of the main bodies 9, 9' and the electric heating elements 10, 10 metallic foils 18, 18, such as aluminium foils.

Figure 4:
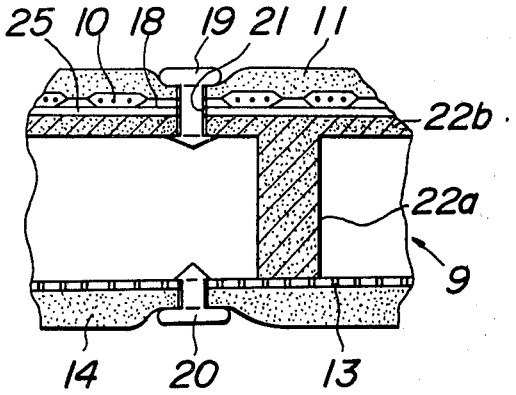
FIG. 4 is a fragmentary sectional view of the seat cover shown in FIG. 1.

The trimming sheet 12, cushion layer 11, electric heating elements 10 and metallic foils 18 are held in position by buttons 19 which engage with one sides of the main bodies 9, 9'. Similarly, the trimming sheet 15 and cushion layer 14 are held in position by buttons 20 which engage with the other sides of the main bodies 9, 9'. In FIG. 4, reference numeral 21 denotes holes for passing the buttons.

Figure 5:
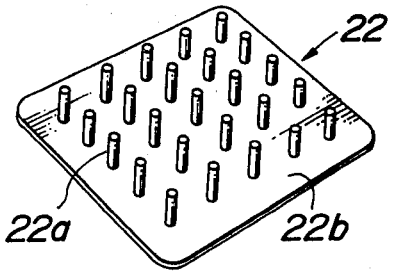
FIG. 5 is a perspective view of a core of the seat cover shown in FIG. 1.

The main bodies 9, 9' each includes a core 22 as shown in FIG. 5, which consists of resilient material and has a plurality of pin-shaped parallel projections 22*a* projecting from a base plate 22*b* toward the holes 13 in the main bodies 9, 9'. The rigidity of those projections 22*a* are determined such that, when the body weight of the driver or passenger is applied thereto, the core 22 is deformed to conform with both the seat and the user's body, but the air passage 8 between the projections 22*a* is not closed. The core is enclosed by a bag-like sheet material 25, one side of which is formed with said holes 13. The periphery 24 of the sheet material 25 is spaced from the periphery of the base plate 22*b*. By this, the edge of the seat cover can be rounded.

Figure 3:
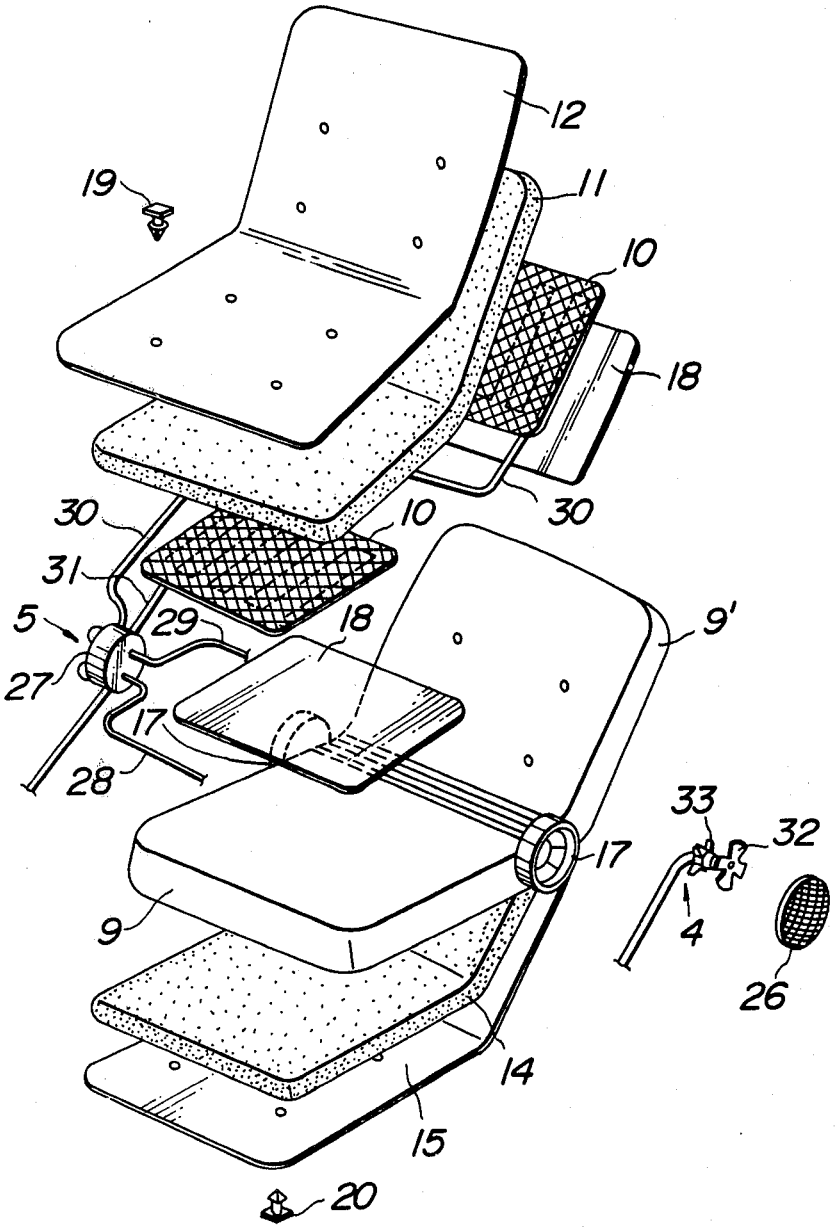
FIG. 3 is an exploded perspective view of the seat cover shown in FIG. 1.

As shown in FIG. 3, one of the cylindrical projection 17 at the connection of the seat portion 2 and the back portion 3 is closed by a dish-like grid 26, and accommodates therein the air recirculating device 4 which includes a blower 32 driven by a motor 33. The other cylindrical projection 17 accommodates a temperature controlling element 27 of the temperature controller 5. This controlling element 27 is connected with temperature detecting elements 28, 29 of the electric heating elements 10, 10. The controlling element 27 supplies the heating elements 10, 10 with controlled current through lead wires 30, 31, respectively.

The above described seat cover is used in the following manner. In winter, the seat cover 1 is mounted on the vehicle seat A such that the heating elements 10, 10 are on the upper side of the seat cover. The temperature controlling element 27 is connected to the vehicle-mounted battery. As the controlling element is manually operated, the heating elements 10, 10 are supplied with current and heated thereby. The temperature of the heating elements are respectively detected by the detecting elements 28, 29 to effect a feed-back control of the current supplied to the heating elements 10, 10. By this, the temperature is maintained at a substantially constant level which can be varied, if necessary. During this heating, the heat radiation toward the seat is reflected by the metallic foils 18, 18 so that the driver or passenger on the seat is more effectively heated. Further, the cushion layer 11 improves a comfortable and warm feeling around the waist of the driver or passenger. In summer, on the other hand, the seat cover 1 is used upside-down. Namely, the seat cover 1 is mounted on the seat A such that the heating elements 10, 10 are on the lower side of the seat cover. The motor 33 is connected to the vehicle-mounted battery. Thus, the blower 32 sucks air in the cabin through the grid 26, and discharges the air through the passage 8, holes 13 on one side of the sheet material 25, cushion layer 14 and holes in the trimming sheet 15. By this, the recirculating air cools the human body and the seat cover to dissipate the stored heat and evaporate the sweat.

In this way, the seat cover according to the present invention can be used through all the seasons of the year. All the necessary components are accommodated in the seat cover so that what is required is just to mount the seat cover on the vehicle seat and electrically connect the seat cover with the vehicle-mounted battery.

The seat cover according to the present invention includes a core which consists of resilient material and provides a sufficient flexibility to conform with both the user's body and the vehicle seat, without closing the air passage, so that the user's comfort is considerably improved.

Although the core of the seat cover is enclosed by a bag-like sheet material, the periphery of this sheet material is spaced from the periphery of the to provide an improved deformability of the seat cover.

Figure 6:
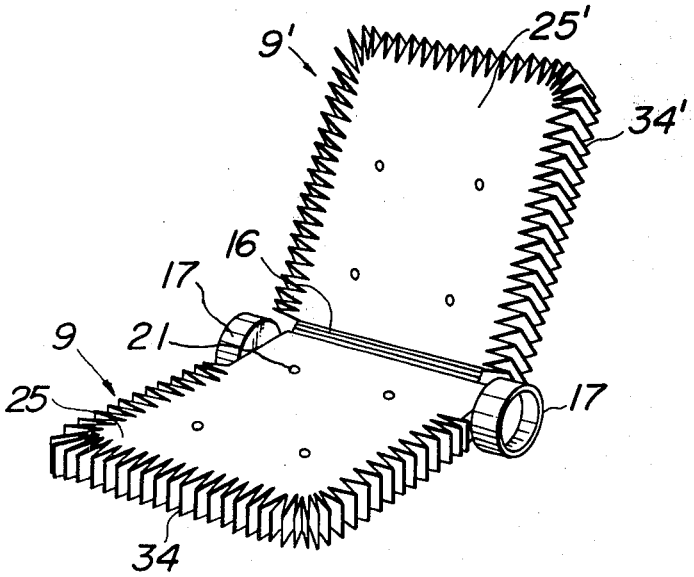
FIG. 6 is a perspective view showing a modification of a main body of the seat cover.

FIG. 6 shows a modification of the seat cover, in which the main bodies 9, 9' each includes a bag-like sheet material 25, 25' which encloses the core shown in FIG. 5. Peripheries 34, 34' of those sheet materials 25, 25' are spaced from the peripheries of the cores, and formed like bellows. By this, the peripheries of the sheet materials are easily deformed into a desired contour.

Figure 2:
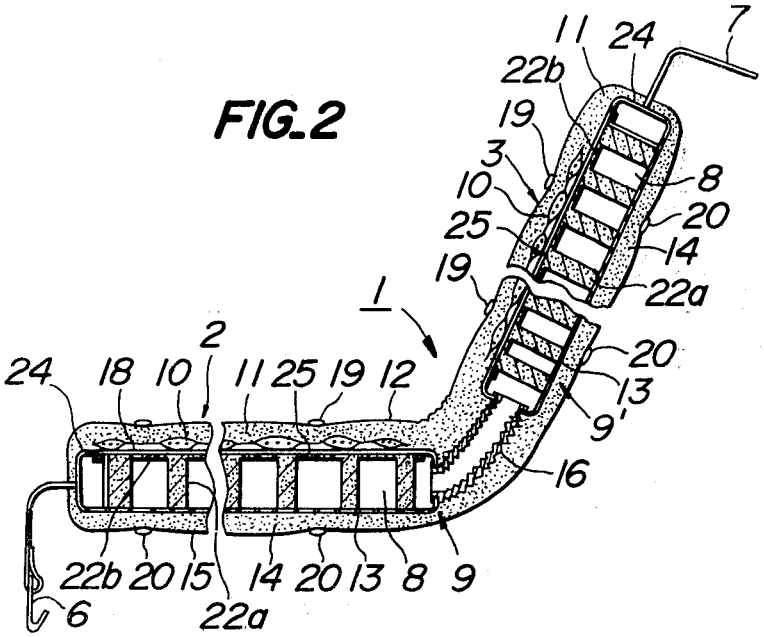
FIG. 2 is a longitudinal-sectional view of the seat cover shown in FIG. 1.
Figure 7:
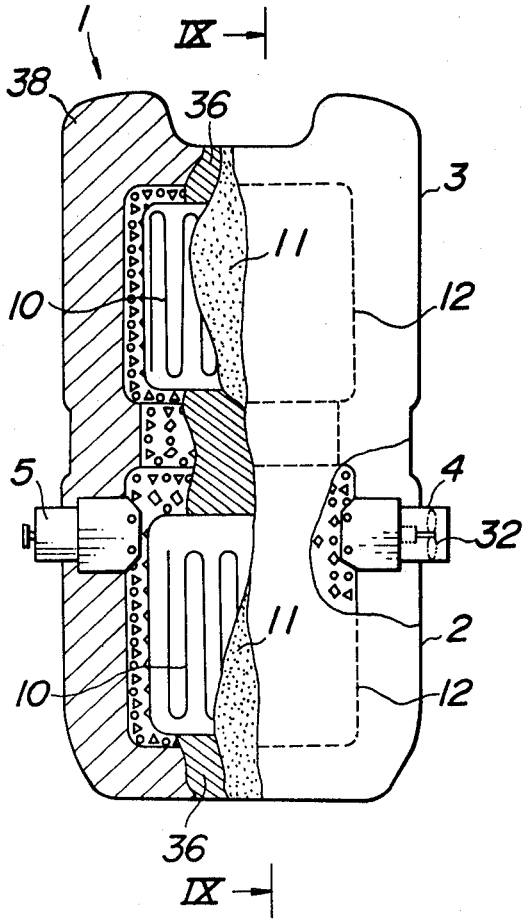
FIG. 7 is a plan view, partly in section, of a seat cover according to another embodiment of the present invention.
Figure 8:
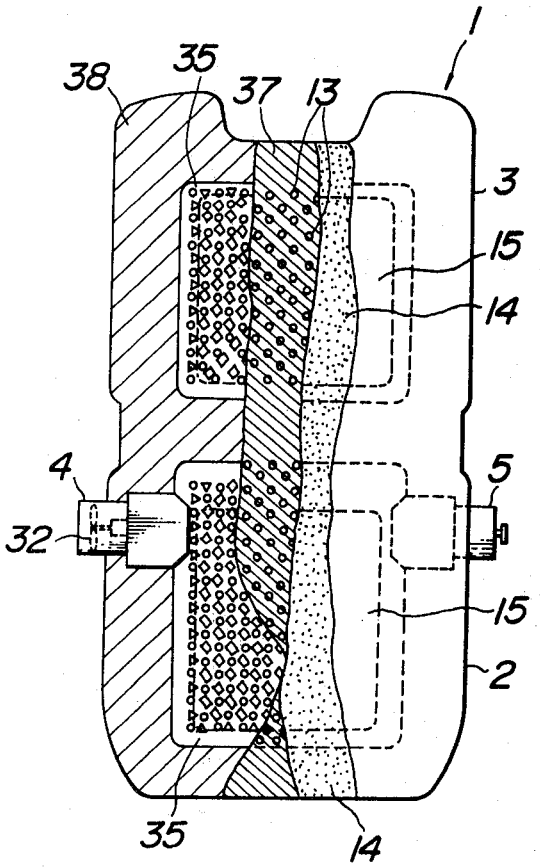
FIG. 8 is a partly sectional bottom view of the seat cover shown in FIG. 7.
Figure 9:
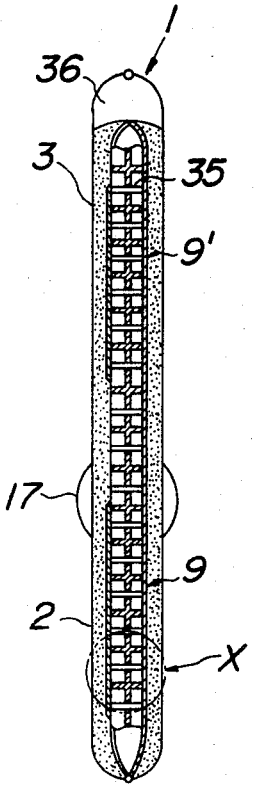
FIG. 9 is a longitudinal-sectional view taken along the line IX—IX of FIG. 7.
Figure 10:
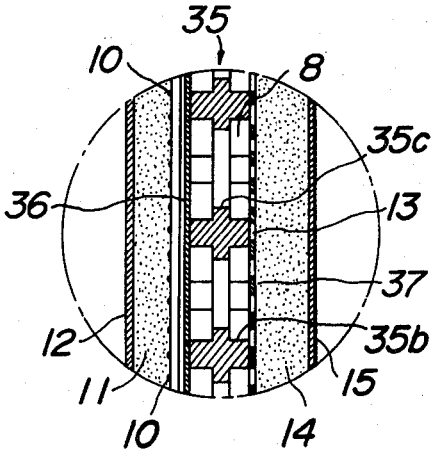
FIG. 10 is an enlarged sectional view showing the portion X in FIG. 9.
Figure 11:
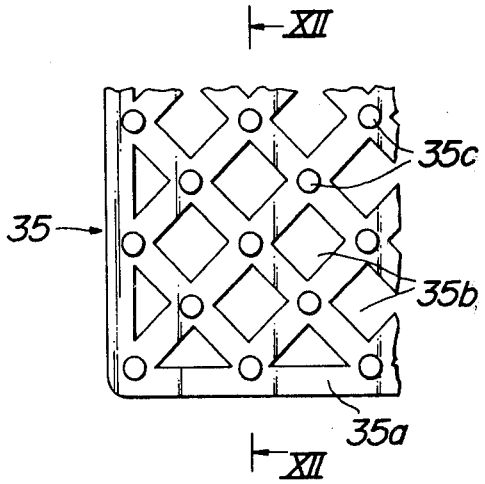
FIG. 11 is a fragmentary plan view of a core of the seat cover shown in FIG. 7.
Figure 12:
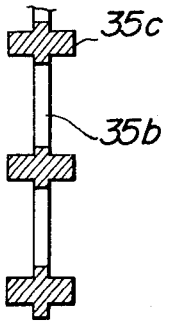
FIG. 12 is a sectional view taken along the line XII—XII in FIG. 11.

FIGS. 7 to 12 show another embodiment of the present invention. Reference numerals used in FIGS. 1 to 6 denote the same or corresponding elements. This embodiment is substantially the same as the previous embodiment, so that the differences only will be explained below. In this embodiment, the main bodies 9, 9' of the seat portion 2 and the back portion 3 each includes a core 35 as shown in FIGS. 11 and 12. The core 35 consists of resilient material and comprises a base plate 35*a* which is in the form of a mesh and has a number of holes 35*b*. Between those holes 35*b*, the base plate is provided with a number of projections 35*c* which project from both sides of the base plate 35*a* to form the air passages 8 on both sides of the base plate 35*a*. Instead of bag-like sheet materials, the cores 35 are covered on both sides by layers 36, 37 of plastics sheet material, respectively, one of which is formed with a number of holes 13 which are in communication with the aire passages 8. As shown in FIGS. 7 and 9, the core 35 is arranged also at the connection between the seat portion 2 and the back portion 3, so that a flexible tube 16 shown in FIG. 2 is not necessary. Further, as shown in FIGS. 7 to 9, the peripheries of the seat portion 2 and the back portion 3 may be surrounded by a resilient pad 38.

By forming a number of holes 35*b* in the base plate 35*a*, the air passage 8 on that side of the base plate 35*a* which is remote from the holes 13 is communicated with the holes 13. Moreover, the base plate 35*a* has a reduced weight and increased flexibility. As the projections 35*c* project from both sides of the base plate 35*a*, the deformability of the core 35 does not change when the seat cover is reversed. The core 35 is not enclosed by a bag-like sheet material which usually disturbs the flexing movement of the core. The manner of warming and cooling the user in winter and summer, per se, is the same as that in the previous embodiment.

From the foregoing description, it will be appreciated that the present invention provides an improved seat cover which can be used through all the seasons of the year and which includes a flexible core designed to conform with both the user is body and the vehicle seat. Consequently, the user's comfort is considerably improved and undesirable permanent deformation of the seat cover is avoided so that a refined appearance is maintained for a long time.

What is claimed is:

1. In a seat cover to be mounted on a vehicle seat and used as a heater and as a ventilator, comprising:

a flat main body including a core which consists of resilient material and defines therein an air passage;

a motor-driven blower which discharges air from one side of the main body through the air passage in the core;

an electric heater which is disposed on the other side of the main body, the improvement which comprises:

said core including a flexible base plate formed with a number of holes and a plurality of relatively rigid, pin-shaped projections which project independently of each other from both sides of the base plate to define therebetween said air passage; said one side of the main body being covered by a plastic sheet having holes and a cushion layer which provides sufficient air permeability to permit passage of air therethrough; said cushion layer being covered by a trimming sheet and a plastic sheet disposed on said other side of the base plate under said heater.

2. The seat cover as claimed in claim 1, wherein said other side of the main body is covered by a cushion layer which provides a sufficient heat storing capacity to store the heat radiated from the electric heater.

3. The seat cover as claimed in claim 2, wherein said cushion layer for said other side of the main body is also covered by a trimming sheet.

4. The sheet cover as claimed in claim 3, wherein said trimming sheet is formed as a bag having a periphery which is spaced from the periphery of the core, said bag being formed with holes on that side thereof which forms part of said a side of the main body.

* * * * *